US005603220A

United States Patent [19]

Seaman

[11] Patent Number: 5,603,220

[45] Date of Patent: Feb. 18, 1997

[54] ELECTRONICALLY CONTROLLED CONTAINER FOR STORING TEMPERATURE SENSITIVE MATERIAL

[75] Inventor: William E. Seaman, Medford, Oreg.

[73] Assignee: Cool Med L.L.C., Reno, Nev.

[21] Appl. No.: 526,442

[22] Filed: Sep. 11, 1995

[51] Int. Cl.[6] ..... F25B 21/02

[52] U.S. Cl. ..... 62/3.7; 62/3.62; 62/457.9

[58] Field of Search ..... 62/3.2, 3.6, 3.62, 62/3.7, 457.9; 136/204, 205

[56] References Cited

U.S. PATENT DOCUMENTS

| | | | |
|---|---|---|---|
| 2,922,284 | 1/1960 | Danielson et al. | 62/3 |
| 3,111,166 | 11/1963 | Munz et al. | 62/3.62 |
| 3,121,998 | 2/1964 | Nagata | 62/3 |
| 3,281,073 | 10/1966 | Chou et al. | 236/15 |
| 3,616,846 | 11/1971 | Willis | 165/26 |
| 3,631,921 | 1/1972 | Pedersen et al. | 165/22 |
| 3,815,815 | 6/1974 | Said | 236/78 |
| 3,933,197 | 1/1976 | Zimmer et al. | 165/2 |
| 4,301,658 | 11/1981 | Reed | 62/3.7 |
| 4,364,234 | 12/1982 | Reed | 62/3.62 |
| 4,407,133 | 10/1983 | Edmondon | 62/3 |
| 4,838,032 | 6/1989 | Maslaney et al. | 62/3.7 |
| 5,088,098 | 2/1992 | Muller et al. | 372/34 |
| 5,217,064 | 6/1993 | Kellow et al. | 165/48.1 |
| 5,234,050 | 8/1993 | Weigert | 165/26 |
| 5,320,162 | 6/1994 | Seaman | 165/2 |
| 5,515,682 | 5/1996 | Nagakubo et al. | 62/3.7 |

*Primary Examiner*—William Doerrler
*Attorney, Agent, or Firm*—Jack M. Wiseman

[57] ABSTRACT

A portable, thermally insulated container having an isothermal chamber for storing temperature sensitive material. An electronic circuit activates a heater when the temperature in the chamber is below a preselected magnitude and activates a Peltier heat pump to cool the chamber when the temperature in the chamber is above a preselected magnitude. The electronic circuit operates a fan for the intake of air into the chamber while the Peltier heat pump is operating and discontinues the operation of the fan while the heater is operating. Included in the electronic circuit are two sets of dual operational amplifiers. A temperature sensor responsive to the temperature in the chamber controls the operation of one set of dual operational amplifiers for operating the Peltier heat pump to cool the chamber and controls the operation of the other set of dual operational amplifiers to heat the chamber.

17 Claims, 5 Drawing Sheets

ELECTRONICALLY CONTROLLED CONTAINER FOR STORING TEMPERATURE SENSITIVE MATERIAL

BACKGROUND OF THE INVENTION

The present invention relates in general to a portable refrigerator/heater unit for the storage and transport of temperature sensitive medical, biological and chemical material and, more particularly, to an electronically controlled portable refrigerator/heater unit for the storage and transport of temperature sensitive medical, biological and chemical material.

Medicants, such as bio-synthetic insulin and bio-synthetic human growth hormone, are temperature sensitive and should be transported and stored within a predetermined temperature environment. If such medicants become frozen, they may be damaged. If the temperatures at which such medicants are transported and stored exceed a predetermined range, they may lose their potency and may become toxic. Equipment heretofore employed for the transporting and storing of such medicants were not satisfactory because protection against freezing did not fulfill the requirements and, also, the temperature at which such medicants were subjected rose to unacceptable levels before arrival at the destination.

The patent to William E. Seaman, U.S. Pat. No. 5,320,162, issued on Jun. 14, 1994, for Single Pole Double Throw Thermostat For Narrow Range Temperature Regulation discloses a portable, thermally insulated storage and transport container for temperature sensitive material. Disposed within the container is a thermostat having a bimetalic strip actuating a single pole, double throw switch. In one position of the switch, temperature below a lower limit of a set point range is sensed. In the other position of the switch, temperature above an upper limit of the set point range is sensed. When the temperature in the container is above the upper limit of the set point range, a Peltier cooler is operated. When the temperature in the container is below the lower limits of the set point range, a heater is operated. A fan provides air flow and convection. In the cooling mode, the fan operates continuously. In the heating mode, the fan is not operated. Power input is provided through a jack which is connected to a 12-volt d.c. source. Connected to the jack is a filter that prevents possible spikes or transients from damaging electronic circuits and prevents radio frequency interference signals which could interfere with other operating equipment.

In the U.S. patent to Reed, U.S. Pat. No. 4,364,234, issued on Dec. 21, 1982, for Control Circuitry For Thermoelectric Environmental Chamber, there is disclosed an electronically controlled, temperature sensitive portable container that operates off a 12-volt battery. The temperature within the chamber of the portable container is maintained within a desired temperature range. A thermoelectric module is operated to heat or cool the environmental chamber for controlling the temperature within the environmental chamber. Operational amplifiers in conjunction with resistors produce the voltages that represent the upper and lower limit of the selected desired temperature.

The U.S. patent to Wills, U.S. Pat. No. 3,616,846, issued on Nov. 1, 1971, for Control System For Heating And/Or Cooling System discloses an electronic system for controlling the temperature within an office building, a home and the like. A bridge circuit provides both a reference voltage and a voltage representative of the temperature in an office building, a home and the like. Within the bridge circuit is a thermistor that changes its resistive value in relationship to the temperature of the environment. The output of the bridge circuit is applied to operational amplifiers. When the sensed temperature exceeds a predetermined magnitude, an operational amplifier changes its state to operate an electronic switch. This action, in turn, operates cooling equipment. When the sensed temperature falls below a predetermined magnitude, another operational amplifier changes its state to actuate another electronic switch. This action, in turn, operates heating equipment.

SUMMARY OF THE INVENTION

An electronic circuit for controlling the temperature within an isothermal chamber of a portable, thermally insulated container used in the storage and transport of temperature sensitive material and substances. The electronic circuit activates a heater when the temperature in the chamber of the container is below a predetermined magnitude and activates cooling equipment when the temperature in the chamber of the container is above a predetermined magnitude. Included in the electronic circuit are dual operational amplifiers connected in cascade. The lead operational amplifier of each dual operational amplifier serves as a comparator circuit and the succeeding operational amplifier of each dual operational amplifier serves as a waveform shaper and controls the activation of a switching circuit. The activation of switches of the switching circuits controls the operation of the heater and cooling equipment to maintain the temperature within the chamber of the container within a prescribed range of temperatures.

An object of the present invention is to provide at a relatively low cost a reliable and practical portable, thermally insulated container to be used in the storage and transport of temperature sensitive material and substances.

A feature of the present invention is that the portable, thermally insulated container of the present invention operates on a 12-volt d.c. power supply so that it may be used in ambulances, trucks, automobiles, and aircraft by means of a vehicle adapter cord.

Another object of the present invention is to provide a portable, thermally insulated container used in the storage and transport of temperature sensitive material and substances that consumes a minimum amount of electrical power and does not produce radio frequency interferences which could interfere with other operating equipment.

Another object of the present invention is to provide a temperature control system for a portable, thermally insulated container used in the storage and transport of temperature sensitive material that is small in dimensions and relatively light in weight.

Another object of the present invention is to provide a temperature control system for a portable, thermally insulated container used in the storage and transport of temperature sensitive material that has low power consumption and, yet, maintains the temperature within the chamber of the container within a precise, prescribed range of temperature.

Another object of the present invention is to provide a portable, thermally insulated container used in the transport and storage of temperature sensitive materials and substances that protects the contents thereof against freezing and, also, maintains the temperature at which such materials are subjected at acceptable magnitude before arrival at the destination.

Another object of the present invention is to provide a portable, thermally insulated container used in the transport and storage of temperature sensitive materials and substances that attains cooling efficiency by the isothermal chamber of the container being maintained in a uniform cool range by operating an air circulating fan while the cooling equipment is cycling on and off.

A feature of the present invention is that an air intake fan is operated while the portable, thermally insulated container is in a cooling mode and does not operate while the portable, thermally insulated container is in a heating mode.

Another feature of the present invention is to provide a portable, thermally insulated container used in the transport and storage of temperature sensitive materials and substances that embodies a Peltier cooler without the need of a d.c. to d.c. converter, thereby eliminating the need of radio frequency interference suppressors.

DESCRIPTION OF THE PREFERRED EMBODIMENT

Figure 1:
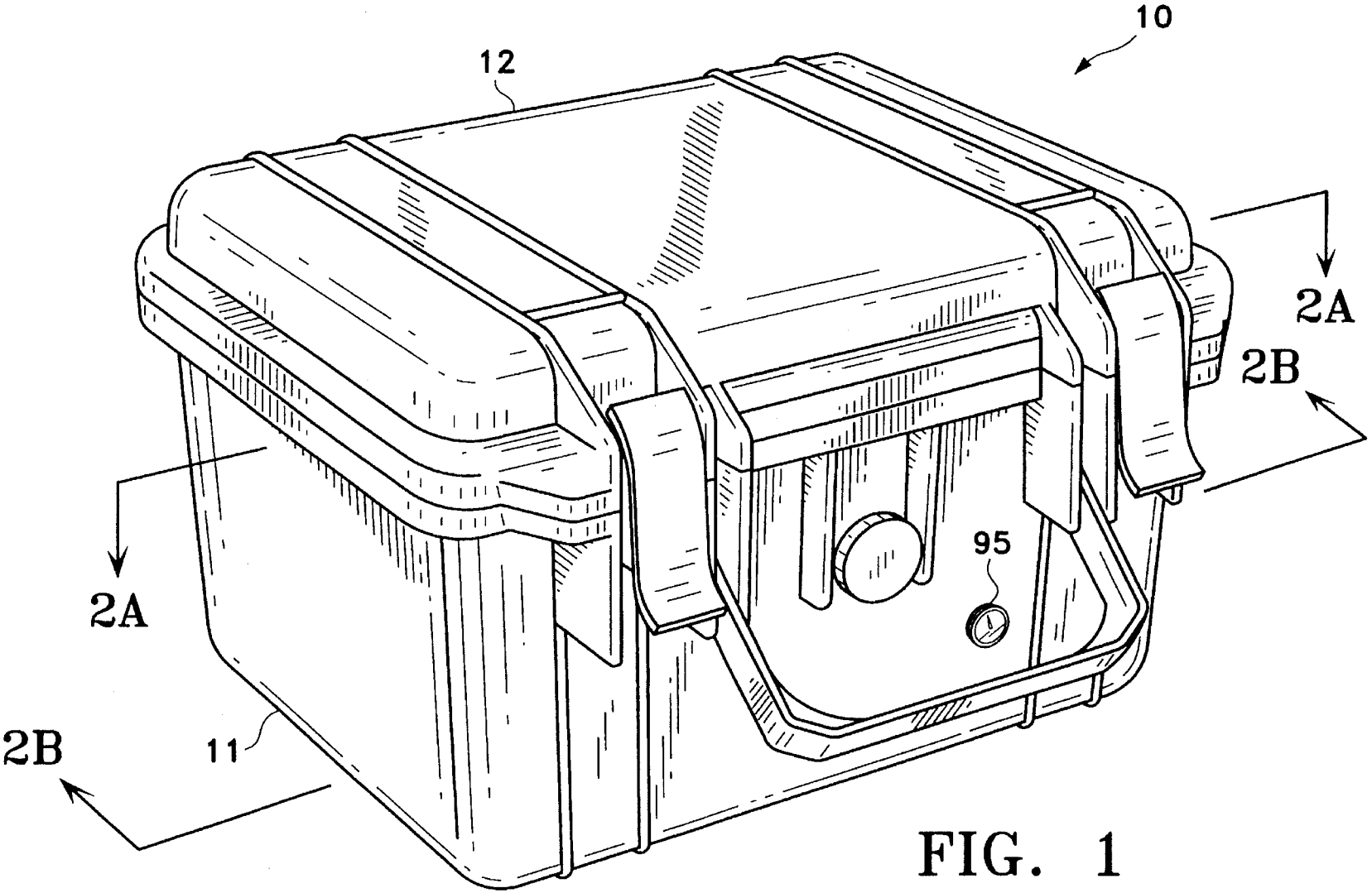
FIG. 1 is a perspective view of a portable, thermally insulated container embodying the present invention used in the transport and storage of temperature sensitive materials and substances illustrated with the cover in the closed position.
Figure 2:
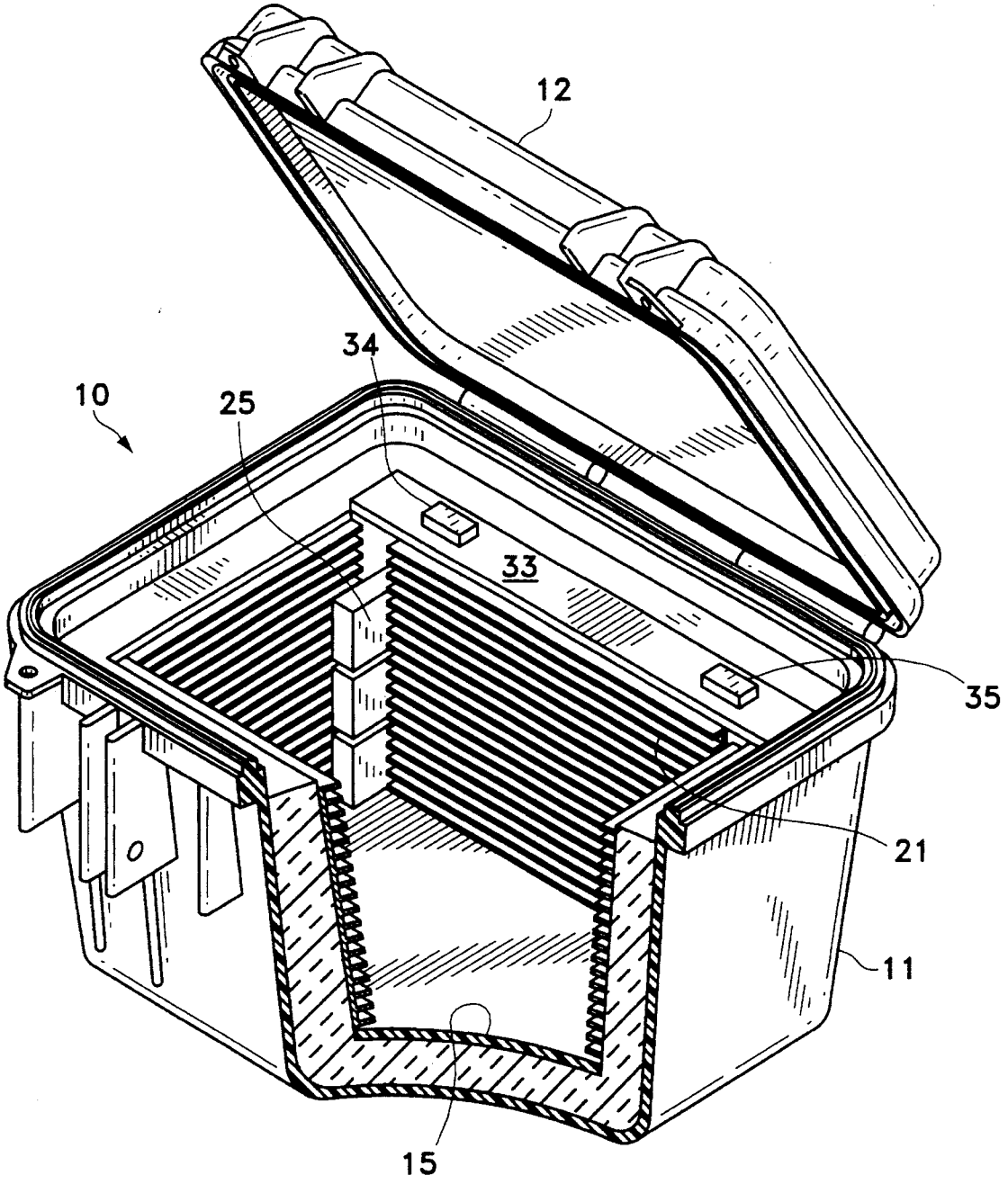
FIG. 2 is a diagrammatic perspective view partially broken away to illustrate the components of the portable, thermally insulated container illustrated in FIG. 1, and shown with the cover thereof in the opened position.
Figure 2A:
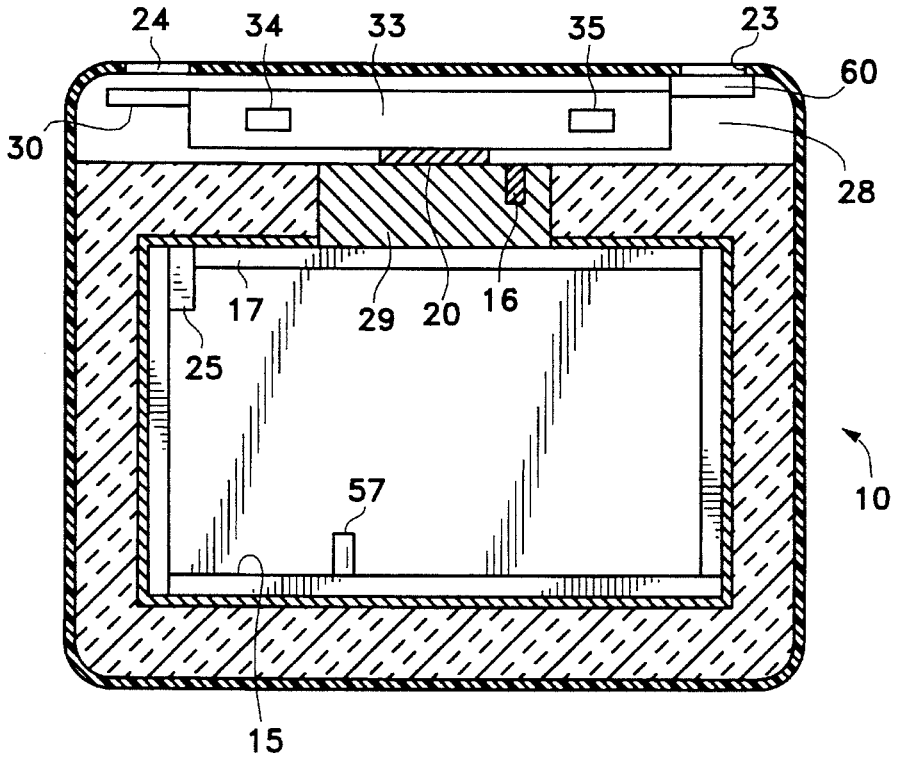
FIG. 2A is a diagrammatic horizontal sectional view of the portable, thermally insulated container shown in FIGS. 1 and 2 taken along line 2A—2A of FIG. 2.
Figure 2B:
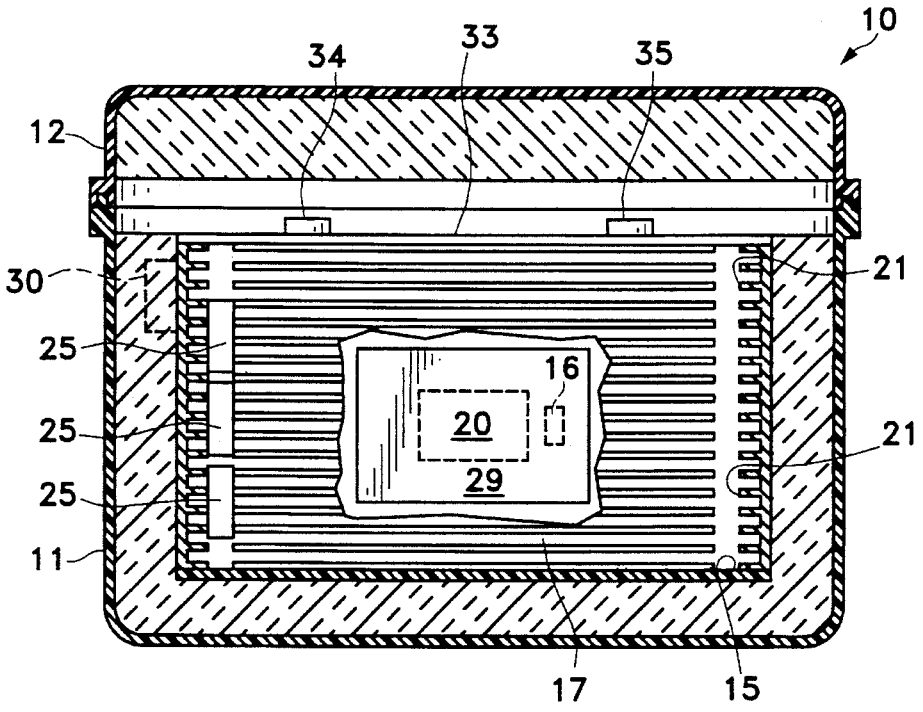
FIG. 2B is a diagrammatic vertical sectional view of the portable, thermally insulated container shown in FIGS. 1 and 2 taken along line 2B—2B of FIG. 2 and partially broken away to illustrate heating and cooling equipment.

Illustrated in FIGS. 1, 2, 2A, and 2B is a portable, thermally insulated container 10 embodying the present invention. The container 10 is used in the storage and transport of temperature sensitive material and substances and comprises a thermally insulated, hollow body 11 and a thermally insulated cover 12. When the cover 12 is closed and latched to the body 11, a thermally insulated isothermal chamber 15 is formed, which stores therein temperature sensitive material and substances.

The isothermal chamber 15 is a heat conductive cold chamber. Within the hollow body 11 is a suitable electrical resistance heater 16. In the exemplary embodiment, the heater 16 is a conventional ceramic coated heater employing a heater resistor. Located within the isothermal chamber 15 is a thermal or heat exchange plate 17 which defines a narrow heat conductive path for conducting heat to a location exterior of the container 10. The heat exchange plate 17, in the preferred embodiment, has a fin-shape configuration to increase the surface area available for heat exchange. Within the heat conductive path is disposed suitable cooling equipment 20. In the preferred embodiment, the cooling equipment is a Peltier heat pump 20. To insure proper air circulation, the inner insulation walls have a fin-shape configuration to conform with the fin-shape configuration of the heat exchange plate 17.

While reference may be made to a Peltier heat pump, it is known that a thermoelectric heat pump may be employed to remove thermal energy resulting in a thermoelectric cooling device. In the preferred embodiment, the Peltier heat pump is of the type manufactured by Megaland, Ltd. located in China, Model No. TEC 1-191026. In the exemplary embodiment, a Melcor type CP1.0 -127- 08L may be employed as the Peltier heat pump, which is manufactured by Melcor Incorporated, of Trenton, N.J.

The narrow heat conductive path conducts heat from the isothermal chamber 15 to the atmosphere through an exhaust port 24. The narrow heat conductive path comprises the finned heat exchange plate 17, a thermal shim block 29, the Peltier heat pump 20, and a heat sink 33. In the cooling mode, the cold side of the Peltier heat pump is tightly thermally coupled to the thermal shim block 29. The thermal shim block 29 is tightly thermally coupled to the finned heat exchange plate 17. This arrangement cools the air within the isothermal chamber 15.

Heat extracted from the thermal chamber 15 and the heat generated from the electrical power for operating the Peltier heat pump 20 are dissipated by the tight thermal coupling of the hot side of the Peltier pump 20 and the heat sink 33. The heat sink 33 has a fin configuration to increase the surface area for heat exchange to the air flowing over it. Atmospheric air is drawn into the chamber 28 through an air intake port 23 by an air intake fan 60. After the atmospheric air advances over the heat sink 33, the air is exhausted from the chamber 28 through an exhaust port 24.

In the heating mode, the heater 16 is activated. Thereupon, the thermal shim block 29 and the heat exchange plate 17 are heated to heat the air within the isothermal chamber 15. The air intake fan 60 operates while the Peltier heat pump 20 is operating to minimize heat losses from the thermal shim block 29 and the heat sink 33. While the air intake fan 60 is not operating, the flow of atmospheric air over the heat sink 33 stops, thus minimizing heat loss resulting from the intake of atmospheric air.

Air circulating fans 25 are employed to circulate the air within the isothermal chamber 15. The circulation of air within the isothermal chamber 15 increases the heat exchange from the heat exchange plate 17 to the air within the isothermal chamber 15 and reduces the temperature differences within the isothermal chamber 15 between the surface of the heat exchange plate 17 and other locations within the isothermal chamber 15. The air circulating fans 25 continuously operate when electrical power is supplied to the thermally insulated container 10 regardless of whether the thermally insulated container 10 is in a heating mode or in a cooling mode. The air intake fan 60, however, operates only during the operation of the Peltier heat pump 20.

Disposed within the chamber 28 is a printed circuit for an electronic circuit 30 which electronic circuit 30 controls the operation of the heater 16 and the Peltier heat pump 20 to maintain the temperature within the isothermal chamber 15 within a predetermined range. Connected to the electronic circuit 30 is either a suitable d.c. power supply, not shown, or a vehicle power cord, not shown, that supplies, in the exemplary embodiment, a 12-volt direct current for the electronic circuit 30. The vehicle power cord is connected to a conventional vehicle battery. Mounted on the hollow body 11 is a control panel 33 with an on-off switch 34 and a temperature range select switch 35. The temperature range switch 35, in the exemplary embodiment, is a two position switch. One setting is for a low preset point of a preselected temperature range and the other setting is for a high preset point of the preselected temperature range. A temperature sensor 57 is suitably located within the isothermal chamber 15 opposite from the location of the heat exchange plate 17 to detect the temperature within the isothermal chamber.

The thermal shim block 29 is mounted within the body 11 spaced from the isothermal chamber 15. In the exemplary embodiment of the present invention, the heater 16 is mounted inside the thermal shim block 29. In a modification of the present invention, the heater 16 and the temperature sensor 57 are placed in direct contact with the heat exchange plate 17. The air intake fan 60 is mounted on the body 11 adjacent the air intake port 23 for drawing air from the atmosphere into the chamber 28.

Figure 3:
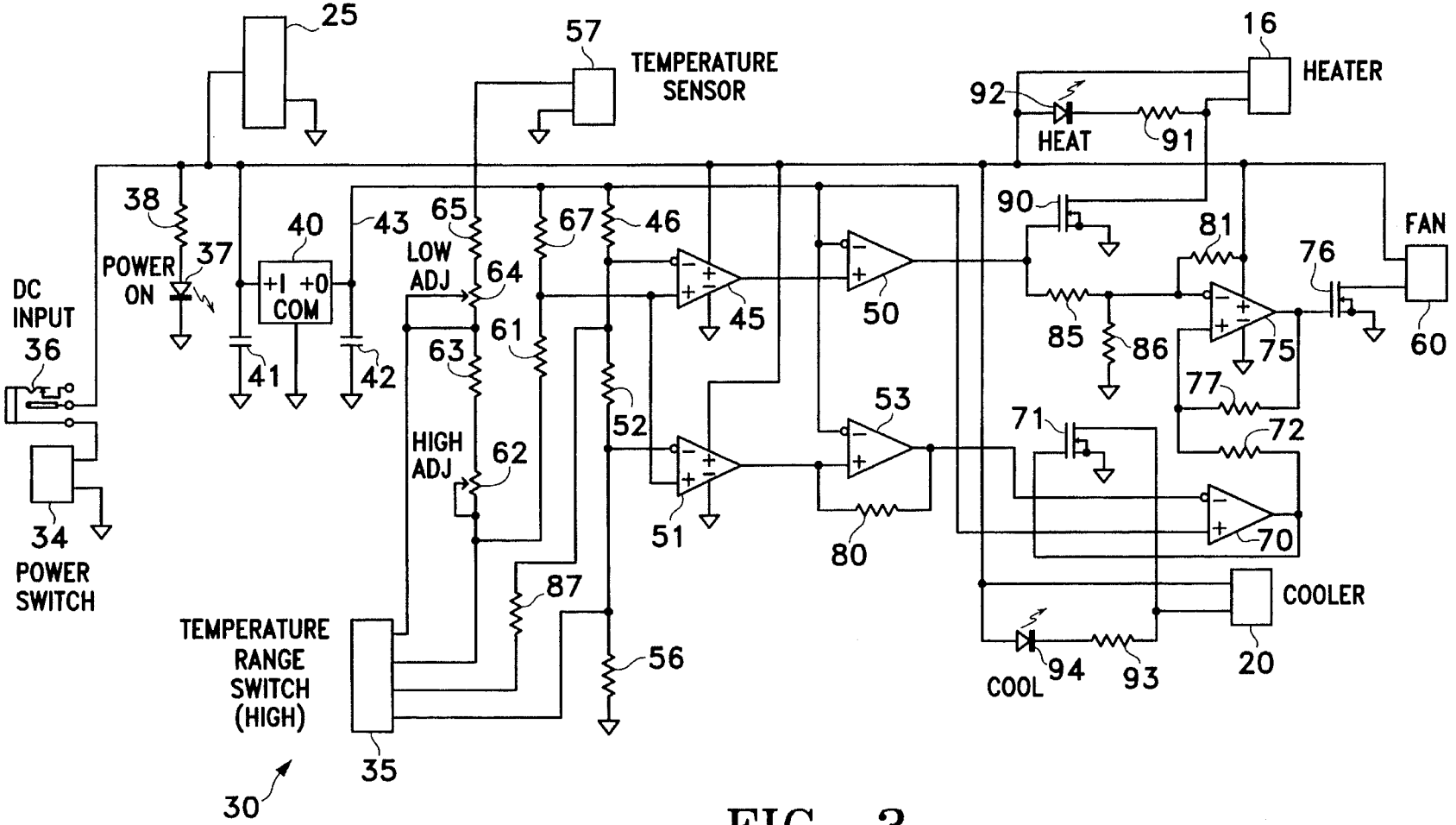
FIG. 3 is a schematic circuit diagram of an electronic circuit for controlling the temperature within an isothermal chamber of the portable, thermally controlled insulated container shown in FIGS. 1 and 2.

Illustrated in FIG. 3 is the electronic circuit 30 for controlling the temperature within the isothermal chamber 15 of the portable, thermally controlled insulated container 10. The electronic circuit 30 comprises a suitable connector jack 36 for establishing an electrical connection with the vehicle power cord or a suitable d.c. power supply. In the exemplary embodiment, a 12-volt d.c. voltage is applied to the connector jack 36 when the power switch 34 is turned on. While the power switch 34 is in the "on" position, a suitable light emitting diode 37 is energized through a suitable current limiting resistor 38.

Connected to the jack 36 is a suitable low power consuming voltage regulator 40. In the exemplary embodiment, the voltage regulator 40 is manufactured by National Semiconductor of Santa Clara, Calif., as the LP 2950ACZ-5.0. The output of the voltage regulator 40, in the exemplary embodiment, is 5-volts d.c.

A suitable capacitor 41 is connected to the output of the jack 36 and the input of the voltage regulator 40 and a suitable capacitor 42 is connected to the output of the voltage regulator 40 and a conductor 43. The capacitors 41 and 42 serve to prevent alternating current ripples or pulses from being emitted from the electronic circuit 30 to reduce alternating current ripples or pulses which could interfere with other operating equipment.

A comparator or lead operational amplifier 45 has one input thereof connected to the conductor 43 for applying a reference voltage thereto through a resistor 46. A waveform shaper or switch control operational amplifier 50 has one input thereof connected to the conductor 43 for applying a reference voltage thereto. The waveform shaper operational amplifier 50 sharpens the characteristics of the signal advancing from the comparator operational amplifier 45. The operational amplifiers 45 and 50 are dual operational amplifiers connected serially and in cascade. A comparator or lead operational amplifier 51 has one input thereof connected to the conductor 43 through the resistor 46 and through a resistor 52. The resistors 46 and 52 are connected in series and are connected to ground through a resistor 56. A resistor 87 is connected in parallel with the resistor 52. Thus, the reference voltage for the comparator operational amplifier 51 is lower than the reference voltage for the comparator operational amplifier 45. When the temperature range switch 35 is selected for a low preset point of a preselected range, the resistor 52 determines the difference in reference voltage applied to the comparator operational amplifiers 45 and 51. When the temperature range switch 35 is selected for a high preset point of the preselected temperature range, the resistor 52 and a resistor 87 determine the difference in reference voltage applied to the comparator operational amplifiers 45 and 51. A waveform shaper or switch control operational amplifier 53 has one input thereof connected to the conductor 43 for applying a reference voltage thereto. The waveform shaper or switch control operational amplifier 53 sharpens the characteristics of the signal from the comparator operational amplifier 51. The operational amplifiers 51 and 53 are dual operational amplifiers connected serially and in cascade.

The operational amplifers 45, 50, 51 and 53 are low power consuming d.c. amplifiers using CMOS semiconductors. In the exemplary embodiment, the operational amplifiers 45, 50, 51 and 52 are manufactured by Texas Instruments of Dallas, Tex., as type TLC 27L2. The operational amplifiers 45, 50, 51 and 53, in the exemplary embodiment, provide in the respective outputs thereof a variation of a high potential of 12-volts to a low potential of 0-volts or ground in response to a differential of several microvolts between the comparison voltage and the reference voltage.

Disposed within the chamber 15 is the suitable silicon low power consuming temperature sensor 57. In the exemplary embodiment, the sensor 57 is manufactured by Motorola, Inc. of Phoenix, Ariz., as the MTS 102. The sensor 57 senses the temperature within the chamber 15 and produces a voltage drop thereacross commensurate with and representative of the temperature within the chamber 15. In the exemplary embodiment, the temperature sensor 57 is disposed in the isothermal chamber 15 opposite from the heat exchange plate 17.

A reference voltage is applied to the temperature sensor 57 from the voltage regulator 40 over the following path: conductor 43, resistor 67, resistor 61, trimmer potentiometer 62, resistor 63, trimmer potentiometer 64, and resistor 65. When the temperature in the chamber 15 rises above the high preset point of the preselected temperature range, the voltage across the temperature sensor 57 falls. As a consequence thereof, the comparison voltage applied to the comparator operational amplifiers 45 and 51 drop proportionately with the rise of the temperature in the chamber 15. The comparison voltage is applied to the comparator operational amplifiers 51 and 45, respectively, over the following path: temperature sensor 57, resistor 65, trimmer potentiometer 64, resistor 63, trimmer potentiometer 62, and resistor 61. The high preset point of the preselected temperature range is determined by the setting of the temperature range switch 35 and the setting of the trimmer potentiometers 64 and 62.

When the comparison voltage applied to the comparator operational amplifier 51 is less than the reference voltage applied to the comparator amplifier 51, the output of the comparator amplifier 51 is at a low potential. Thereupon, the output of the waveform shaper operational amplifier 53 goes to a low potential. Connected to the output of the waveform shaper operational amplifier 53 is a phase inverter operational amplifier 70. In the exemplary embodiment, the phase inverter operational amplifier 70 is manufactured by Texas Instruments of Dallas, Tex., as type TLC 26L2. The phase inverter, operational amplifier 70 is a low power consuming d.c. amplifier using CMOS semiconductor.

When the output of the waveform shaper operational amplifier 53 is at a low potential, the output of the phase inverter operational amplifier 70 is at a high potential. This action causes a power transistor 71 to conduct. In the exemplary embodiment, the power transistor 71 is a power MOSFET N-channel transistor made by Motorola, Inc. of Phoenix, Ariz., as the BUZ71A transistor. While the power transistor 71 conducts, the Peltier heat pump 20 operates for cooling the chamber 15.

Also connected to the output of the phase inverter operational amplifier 70 through a resistor 72 is a fan control operational amplifier 75. The fan control, operational amplifier 75 is a low power consuming d.c. amplifier using CMOS semiconductor. In the exemplary embodiment, the fan control operational amplifier 75 is manufactured by Texas Instruments of Dallas, Tex., as type TLC 27L2. When the output of the phase inverter operational amplifier 70 has a high potential output, the output of the fan control operational amplifier 75 is at a high potential. The operational amplifiers 70 and 75, in the exemplary embodiment, provide in the respective outputs thereof a variation of a high potential of 12-volts to a low potential of 0-volts or ground in response to a differential of several microvolts between the comparison voltage and the reference voltage.

Connected to the output of the fan control amplifier 70 is a power transistor 76 for controlling the operation of the air intake fan 60. In the exemplary embodiment, the power transistor 76 is made by Siliconix, of Santa Clara, Calif., as the VNO300L transistor. When the output of the fan control operational amplifier 75 is at a high potential, the power transistor 76 conducts. The conduction of the power transistor 76 causes the air intake fan 60 to operate. Thus, the air intake fan 60 operates while the Peltier heat pump 20 is operating to cool the chamber 15. While the Peltier heat pump 20 is operating to cool the chamber 15, the thermally insulated chamber 10 is in a cooling mode.

As the temperature in the chamber 15 starts to drop and falls below the low preset point of the predetermined or preselected temperature range, the comparison voltage applied to the comparator operational amplifier 51 will rise above the reference voltage applied thereto. Thereupon, the output voltage of the comparator operational amplifier 51 goes to a high potential. In turn, the output of the waveform shaper operational amplifier 53 will go to a high potential and the output of the phase inverter operational amplifier 70 will go to a low potential. Thereupon, the transistor 71 will be rendered non-conductive and the Peltier heat pump 20 will be turned-off.

Should the environmental temperature remain constant, the temperature within the chamber 15 will rise and fall approximately within 1 degree centigrade below the high preset point of the preselected temperature range, causing the Peltier heat pump 20 to cycle on and off. This action holds the temperature within the chamber 15 relatively constant. The fan control operational amplifier 75 includes a resistor 77 interconnecting the output of the switching operational amplifier 75 with an input of the switching operational amplifier 75 to produce an hysteresis during an on-off cycle of the Peltier heat pump. As a consequence thereof, the air intake fan 60 will continue to operate during the on-off cycle of the Peltier heat pump 25. The temperature within the chamber 15 may be held to approximately within 0.1° centigrade of the preselected temperature range. Since such precision is not necessary and a precision of not less than 3° centigrade of the high preset point of the preselected temperature range is adequate, resistor 80 interconnects the output of the waveform shaper operational amplifier 53 to the comparison input thereof to feedback a signal from the output of the waveform shaper, operational amplifier 51 to the comparison input thereof. Similarly, a resistor 81 feeds back a signal from a terminal of the fan control operational amplifier 75 to an input terminal thereof. The resistor 80 and resistor 81, provide an hysteresis for operating the air intake fan 60 during the on and off cycle of the Peltier pump 20 and thereby maintain the temperature within the isothermal chamber 15 to a temperature not less than 3° centigrade of the high preset point of the preselected temperature range. Resistors 72, 77, 81, 85 and 86 maintain the output of the fan control amplifier 75 at a high potential during the normal on and off cycle of the Peltier pump 20 by providing an hysteresis.

In the event the temperature within the isothermal chamber 15 falls below the low preset point of the preselected temperature range, the voltage across the temperature sensor 57 rises. As a result thereof, the comparison voltage applied to the comparator operational amplifiers 45 and 51 increases proportionately with the falling of the temperature in the isothermal chamber 15. The comparison voltage is applied to the comparator operational amplifiers 45 and 51, respectively, over the paths heretofore described. When the increase in comparison voltage applied to the comparator operational amplifier 45 exceeds the reference voltage applied thereto, the output of the comparator operational amplifier 45 will be at a high potential. Thereupon, the output voltage of the waveform shaper amplifier 50 will be at a high potential.

Connected to the output of the waveform shaper operational amplifier 50 is a power transistor 90. In the exemplary embodiment, the power transistor 90 is a power MOSFET N-channel transistor made by Motorola, Inc. of Phoenix, Ariz., as the BUZ71A transistor. When the output of the waveform shaper operational amplifier 50 is at a high potential, the power transistor 90 conducts. While the power transistor 90 conducts, the heater 16 is operated to heat the isothermal chamber 15. When the potential in the output of the waveform shaper operational amplifier 50 is at a high potential, the output of the fan control operational amplifier 75 is at a low potential. The high potential at the output of the waveform shaper operational amplifier 50 causes the reference voltage applied to the operational amplifier 75 to increase and thereby exceed the comparison voltage transmitted from the phase inverter operational amplifier 70. As a consequence thereof, the power transistor 76 does not conduct and the air intake fan 60 stops operating. The air intake fan 60 does not operate while the heater 16 is operating and the air intake fan 60 does not operate until the container 10 is in a cooling mode. The foregoing operations result in maximum cooling efficiency, since the container 10 is kept as cool as possible while the Peltier heat pump 20 is cycling on and off and because heat in the isothermal chamber 15 is not evacuated to the atmosphere when heat is required in the isothermal chamber 15. Should the environmental temperature remain constant, the temperature within the isothermal chamber 15 will rise and fall approximately within 1 degree centigrade above the low preset point of the preselected temperature range.

Connected to the heater 16 through a current limiting resistor 91 is a suitable light emitting diode 92 that glows when the heater 16 is operating. Connected to the Peltier heat pump 20 through a current limiting resistor 93 is a suitable light emitting diode 94 that glows when the Peltier heat pump 20 is operating. A suitable remote thermometer 95 is inserted through the body 11 and into the chamber 15 to give a remote reading of the temperature in the chamber 15. The stem of the thermometer 95 enters the chamber 15. Reotemp Instrument Corporation of San Diego, Calif., manufactures a dial, bimetal thermometer that is suitable for this purpose. A suitable silicone filling is employed for maintaining an airtight connection between the thermally insulated body 11 and the remote thermometer 95.

Figure 4:
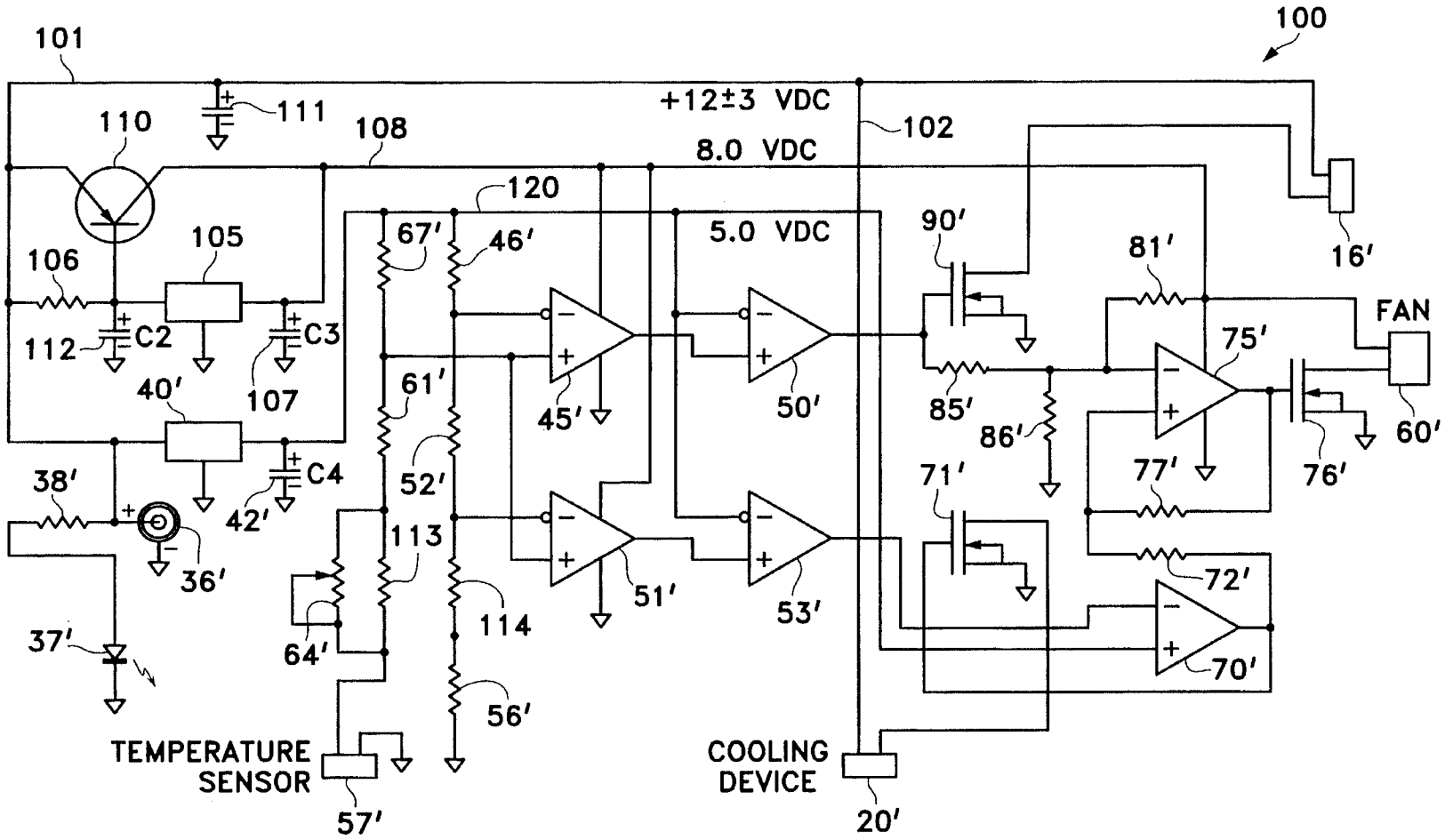
FIG. 4 is a schematic circuit diagram of an electronic circuit for controlling the temperature within the isothermal chamber which is a modification of the electronic circuit shown in FIG. 3.

Illustrated in FIG. 4 is an electronic circuit 100 which is a modification of the electronic circuit 30. The components of the electronic circuit 100 similar in structure and operation to the components described in the electronic circuit 30 will be designated the same reference numeral with a prime suffix.

The electronic circuit 100 is suitable for use with a portable, thermally insulated container that lends itself to consumer use. The chamber of the portable, thermally insulated container, in the exemplary embodiment, may be formed from die-cast aluminum. By reducing the size of the thermally conductive chamber in which the temperature sensitive material is stored, the need for the air circulation fans 25 have been obviated. In addition, the electronic circuit 100 has eliminated the temperature range switch 35, the heater light emitting diode 92, the cooling light emitting diode 94, and the high temperature range trimmer potentiometer 62.

For improved operation, the air intake fan 60' and the operational amplifiers 45', 50', 51', 53' and 75' are operated at a direct current voltage of the same magnitude. In the exemplary embodiment, the air intake fan 60' and the operational amplifiers 45', 50', 51', 53' and 75' are operated at eight volts direct current. The heater 16' and the Peltier heat pump 20', in the exemplary embodiment, are operated at a direct current voltage of the same magnitude. In the exemplary embodiment, the heater 16' and the Peltier heat pump 20' are operated at twelve volts direct current. The twelve volt direct current voltage is applied to the heater 16' over conductor 101. The twelve volt direct current voltage is applied to the Peltier heat pump 20' over the conductors 101 and 102.

For applying the eight-volt direct current voltage to the fan 60' and the operational amplifiers 45', 50', 51', 53' and 75', a suitable voltage regulator 105 is connected at its input to a direct current source through the jack 36' and a resistor 106. A suitable capacitor 107 is connected to the output of the voltage regulator 105. The capacitor 107 serves to prevent alternating current ripples or pulses from being emitted from the electronic circuit 100 to reduce alternating current ripples or pulses which could interfere with other operating equipment. In the exemplary embodiment, the voltage regulator 105 is of the type manufactured by Motorola, Inc. of Phoenix, Ariz., as the 340J-8.

The eight-volt direct current output of the voltage regulator 105 is applied to the air intake fan 60' and the operational amplifiers 45', 50', 51', 53' and 75' over conductor 108. A PNP transistor 110 is connected across a resistor 106 and is connected to the voltage regulator 105 to increase the available current output of the voltage regulator 105. The PNP transistor 110 is of the type manufactured by Motorola, Inc. of Phoenix, Ariz., as the 2N6490. As more current is demanded by the operation of the fan 60', the voltage drop across the resistor 106 increases causing the transistor 110 to conduct. The voltage regulator 105 is capable of supplying ample current without the overheating of either the transistor 110 or the voltage regulator 105. Capacitors 111 and 112 are provided to increase stability and dampen possible oscillations. Resistor 113 is connected in parallel with the low temperature range trimmer potentiometer 64'. Resistor 114 is connected between the resistor 52' and the resistor 56'. A reference voltage is applied to the temperature sensor 57' over the following path: resistor 67', resistor 61', and resistor 113 in parallel with the low range timmer potentiometer 64'.

When the temperature in the chamber 15 rises above the high preset point of the preselected temperature range, the voltage across the temperature sensor 57' falls. As a consequence thereof, the comparison voltage applied to the comparator operational amplifiers 45' and 51' drop proportionately with the rise of the temperature in the chamber 15. The comparison voltage is applied to the comparator operational amplifiers 45' and 51' over the following path: temperature sensor 57', parallel trimmer potentiometer 64' and resistor 113 and resistor 61'. In the event the temperature within the isothermal chamber 15 falls below the low preset point of the preselected temperature range, the voltage across the temperature sensor 57' rises. As a result thereof, the comparison voltage applied to the comparator operational amplifiers 45' and 51' increases proportionately with the falling of the temperature in the isothermal chamber 15. The comparison voltage is applied to the comparator operational amplifiers 45' and 51', respectively, over the paths heretofore described.

A reference voltage is applied to the operational amplifiers 50' and 53' via a conductor 120. A reference voltage is applied to the operational amplifier 45' via the conductor 120 and a resistor 46'. A reference voltage is applied to the operational amplifier 51' via the conductor 120, the resistor 46' and the resistor 52'. The resistors 46' and 52' are connected in series and are connected to ground through a resistor 114 and a resistor 46'. Thus, the reference voltage for the comparator operational amplifier 51' is lower than the reference voltage for the comparator operational amplifier 45'. The resistor 52' determines the difference in reference voltage applied to the operational amplifiers 45' and 51'. Hence, the resistor 52' determines the preselected temperature range between the high preset point and the low reset point.

The employment of voltage regulator 105, in addition to the voltage regulator 40', improves the reliability and stability of the thermally insulated container 10 of the present invention. In addition, voltage sensitive semiconductors as well as operational amplifiers are protected against transient voltage surges and spikes which may appear in the source of power.

What is claimed is:

1. A container for temperature sensitive material comprising:

(a) a chamber for storing temperature sensitive material;

(b) a temperature sensor responsive to the temperature in said chamber;

(c) a cooling device for cooling said chamber;

(d) a first operational amplifier, which operates as a waveform shaper for controlling the operation of said cooling device; and (e) a second operational amplifier responsive to said temperature sensor to control the operation of said first operational amplifier for controlling the temperature in said chamber.

2. A container for temperature sensitive material as claimed in claim 1 wherein said first operational amplifier and said second operational amplifier are connected in series as dual operational amplifiers.

3. A container for temperature sensitive material as claimed in claim 2 wherein a circuit applies a reference voltage to one input of said second operational amplifier and applies a comparison voltage to another input of said second operational amplifier in response to said temperature sensor for said second operational amplifier to compare said comparison voltage and said reference voltage in the controlling of the operation of said first operational amplifier.

4. A container for temperature sensitive material comprising:

(a) a chamber for storing temperature sensitive material;

(b) a temperature sensor responsive to the temperature in said chamber;

(c) a cooling device for cooling said chamber;

(d) a first operational amplifier for controlling the operation of said cooling device;

(e) a second operational amplifier responsive to said temperature sensor to control the operation of said first operational amplifier for controlling the temperature in said chamber; said first operational amplifier and said second operational amplifier being connected in series as dual operational amplifiers; and (f) a circuit applying a reference voltage to one input of said second operational amplifier and applying a comparison voltage to another input of said second operational amplifier in response to said temperature sensor for said second operational amplifier to compare said comparison voltage and said reference voltage in the controlling of the operation of said first operational amplifier, said circuit applying a reference voltage to one input of said first operational amplifier and the output of said second operational amplifier applying a comparison voltage to another input of said first operational amplifier, said first operational amplifier comparing the reference voltage and the comparison voltage applied thereto for controlling the operation of said cooling device.

5. A container for temperature sensitive material as claimed in claim 1 and comprising a fan for the intake of air into said container, and circuit means interconnecting said first operational amplifier and said fan for operating said fan during the operation of said cooling device.

6. A container for temperature sensitive material as claimed in claim 4 and comprising a fan for the intake of air into said container, said circuit interconnecting said first operational amplifier and said fan for operating said fan during the operation of said cooling device.

7. A container for temperature sensitive material as claimed in claim 1 wherein said cooling device is a Peltier heat pump.

8. A container for temperature sensitive material as claimed in claim 6 wherein said cooling device is a Peltier heat pump.

9. A container for temperature sensitive material as claimed in claim 1 and comprising:

(a) a heating device for heating said chamber;

(b) a third operational amplifier, which operates as a waveform shaper for controlling the-operation of said heating device; and (c) a fourth operational amplifier responsive to said temperature sensor to control the operation of said third operational amplifier for controlling the temperature in said chamber.

10. A container for temperature sensitive material as claimed in claim 2 and comprising:

(a) a heating device for heating said chamber;

(b) a third operational amplifier, which operates as a waveform shaper for controlling the operation of said heating device; and (c) a fourth operational amplifier responsive to said temperature sensor to control the operation of said third operational amplifier for controlling the temperature in said chamber, said third operational amplifier and said fourth operational amplifier being connected in series as dual operational amplifiers.

11. A container for temperature sensitive material comprising:

(a) a chamber for storing temperature sensitive material;

(b) a temperature sensor responsive to the temperature in said chamber;

(c) a cooling device for cooling said chamber;

(d) a first operational amplifier for controlling the operation of said cooling device;

(e) a second operational amplifier responsive to said temperature sensor to control the operation of said first operational amplifier for controlling the temperature in said chamber, said first operational amplifier and said second operational amplifier being connected in series as dual operational amplifiers;

(f) a circuit applying a reference voltage to one input of said second operational amplifier and applying a comparison voltage to another input of said second operational amplifier in response to said temperature sensor for said second operational amplifier to compare said comparison voltage and said reference voltage in the controlling of the operation of said first operational amplifier;

(g) a heating device for heating said chamber;

(h) a third operational amplifier for controlling the operation of said heating device; and (i) a fourth operational amplifier responsive to said temperature sensor to control the operation of said third operational amplifier for controlling the temperature in said chamber, said third operational amplifier and said fourth operational amplifier being connected in series as dual operational amplifiers, (j) said circuit applying a reference voltage to one input of said fourth operational amplifier different in magnitude to the reference voltage applied to said second operational amplifier, said circuit applying a comparison voltage to another input of said fourth operational amplifier in response to said temperature sensor for said fourth operational amplifier to compare said comparision voltage and said reference voltage applied to said fourth operational amplifier for the controlling of the operation of said third operational amplifier.

12. A container for temperature sensitive material as claimed in claim 6 and comprising:

(a) a heating device for heating said chamber;

(b) a third operational amplifier for controlling the operation of said heating device; and (c) a fourth operational amplifier responsive to said temperature sensor to control the operation of said third operational amplifier for controlling the temperature in said chamber, said third operational amplifier and said fourth operational amplifier being connected in series as dual operational amplifiers;

(d) said circuit applying a reference voltage to one input of said fourth operational amplifier different in magnitude to the reference voltage applied to said second operational amplifier, said circuit applying a comparison voltage to another input of said fourth operational amplifier in response to said temperature sensor for said fourth operational amplifier to compare said comparision voltage and said reference voltage applied to said fourth operational amplifier for the controlling of the operation of said third operational amplifier; and (e) a fan for the intake of air into said chamber, said circuit interconnecting said third operational amplifier and said fan for discontinuing the operation of said fan during the operation of said heating device.

13. A container for temperature sensitive material comprising:

(a) a chamber for storing temperature sensitive material;

(b) a temperature sensor responsive to the temperature in said chamber;

(c) a cooling device for cooling said chamber;

(d) a heating device for heating said chamber;

(e) a fan for the intake of air into said container; and (f) a circuit responsive to said temperature sensor for operating said cooling device and said fan while the temperature in said chamber is above a preselected temperature range and for operating said heating device and discontinuing the operation of said fan while the temperature in said chamber is below a preselected range, said cooling device cycling on and off while said temperature in said chamber is within a predetermined range of said preselected temperature range, said circuit comprises means for providing a hysteresis action for operating said fan during the on and off cycle of said cooling device.

14. A container for temperature sensitive material as claimed in claim 13 wherein said circuit comprises first dual operational amplifiers connected in cascade and responsive to said temperature sensor for operating said cooling device and for operating said fan; and second dual operational amplifiers connected in cascade and responsive to said temperature sensor for operating said heating device and discontinuing the operation of said fan.

15. A container for temperature sensitive material comprising:

(a) a chamber for storing temperature sensitive material;

(b) a temperature sensor responsive to the temperature in said chamber;

(c) a cooling device for cooling said chamber;

(d) a heating device for heating said chamber;

(e) a fan for the intake of air into said container; and (f) a circuit responsive to said temperature sensor for operating said cooling device and said fan while the temperature in said chamber is above a preselected temperature range and for operating said heating device and discontinuing the operation of said fan while the temperature in said chamber is below a preselected range, said cooling device cycling on and off while said temperature in said chamber is within a predetermined range of said preselected temperature ranges, said circuit comprises means for providing a hysteresis action for operating said fan during the on and off cycle of said cooling device, said circuit comprising first dual operational amplifiers connected in cascade and responsive to said temperature sensor for operating said cooling device and for operating said fan, and second dual operational amplifiers connected in cascade and responsive to said temperature sensor for operating said heating device and discontinuing the operation of said fan, the lead operational amplifier of said first dual operational amplifiers being a comparator operational amplifier and the succeeding operational amplifier of said first dual operational amplifiers being a waveform-shaper operational amplifier, the lead operational amplifier of said second dual operational amplifiers being a comparator operational amplifier and the succeeding operational amplifier of said second dual operational amplifiers being a waveform-shaper operational amplifier.

16. A container for temperature sensitive material comprising:

(a) a chamber for storing temperature sensitive material;

(b) a temperature sensor responsive to the temperature in said chamber;

(c) a cooling device for cooling said chamber;

(d) a first operational amplifier for controlling the operation of said cooling device;

(e) a second operational amplifier responsive to said temperature sensor to control the operation of said first operational amplifier for controlling the temperature in said chamber;

(f) a heating device for heating said chamber;

(g) a third operational amplifier for controlling the operation of said heating device; and (h) a fourth operational amplifier responsive to said temperature sensor to control the operation of said third operational amplifier for controlling the temperature in said chamber;

(i) a source of power at a first preselected voltage;

(j) a fan for the intake of air into said container;

(k) a first voltage regulator connected to said source of power for providing operating power at a second preselected voltage to said first operational amplifier, said second operational amplifier, said third operational amplifier, said fourth operational amplifier and said fan; and (l) a second voltage regulator connected to said source of power for applying a reference voltage to said first operational amplifier, said second operational amplifier, said third operational amplifier and said fourth operational amplifier, (m) said cooling device and said heating device being connected to said source of power for the application of said first preselected voltage thereto.

17. A container for temperature sensitive material as claimed in claim 16 and comprising:

(a) a resistor interconnecting said source of power and said first voltage regulator; and (b) means connected across said resistor and connected to said first voltage regulator for increasing current flow to said first operational amplifier, said second operational amplifier, said third operational amplifier, said fourth operational amplifier and said fan in response to a reduction in current flow thereto.

* * * * *